US012808274B2

(12) United States Patent
Gallagher et al.

(10) Patent No.: US 12,808,274 B2
(45) Date of Patent: Nov. 24, 2026

(54) KINETIC BLOWOUT PREVENTER

(71) Applicant: Kinetic Pressure Control Ltd., Houston, TX (US)

(72) Inventors: Bobby J. Gallagher, Houston, TX (US); Billy J. Gallagher, Houston, TX (US); Steven A. Angstmann, Houston, TX (US)

(73) Assignee: Kinetic Pressure Control Ltd., Houston, TX (US)

( * ) Notice: Subject to any disclaimer, the term of this patent is extended or adjusted under 35 U.S.C. 154(b) by 4 days.

(21) Appl. No.: 19/241,369

(22) Filed: Jun. 17, 2025

(65) Prior Publication Data

US 2025/0376906 A1 Dec. 11, 2025

Related U.S. Application Data

(63) Continuation-in-part of application No. 18/105,185, filed on Feb. 2, 2023, now abandoned.

(51) Int. Cl.
*E21B 33/06* (2006.01)
*E21B 29/00* (2006.01)

(52) U.S. Cl.
CPC ..... *E21B 33/06* (2013.01); *E21B 29/002* (2013.01)

(58) Field of Classification Search
CPC ..... E21B 33/06
See application file for complete search history.

(56) References Cited

U.S. PATENT DOCUMENTS

| | | | | |
|---|---|---|---|---|
| 3,504,885 | A * | 4/1970 | Hulsey | F16K 3/0227 251/328 |
| 6,454,015 | B1 * | 9/2002 | Armstrong | F16K 3/0263 166/85.4 |
| 8,651,190 | B2 * | 2/2014 | Dietz | E21B 33/064 166/368 |
| 9,804,039 | B2 * | 10/2017 | Reyes, III | G01N 29/227 |
| 10,000,987 | B2 * | 6/2018 | Springett | E21B 34/16 |
| 10,900,347 | B2 * | 1/2021 | Amsellem | E21B 47/117 |
| 11,028,664 | B2 * | 6/2021 | Gallagher | E21B 33/063 |
| 11,788,374 | B2 * | 10/2023 | Gallagher | E21B 29/02 166/85.4 |
| 2008/0196888 | A1 * | 8/2008 | Judge | E21B 33/061 251/1.3 |
| 2017/0328166 | A1 * | 11/2017 | Jennings | E21B 33/063 |
| 2024/0263541 | A1 * | 8/2024 | Angstmann | E21B 33/0355 |

* cited by examiner

*Primary Examiner* — Aaron L Lembo
(74) *Attorney, Agent, or Firm* — Victor H. Segura

(57) ABSTRACT

A blowout preventer including a main body having a through bore; an insert having a first segment and a second segment defining a passage between the segments oriented transverse to the through bore; the first segment and the second segment each configured with a plurality of seals to restrict fluid flow from the though bore, wherein each seal is configured for energization; a cutter configured for motion to sever objects in the through bore; a gate configured for motion in the transverse passage; and a charge configured for activation to propel the gate to move the cutter across the through bore. A method of operating a blowout preventer.

18 Claims, 18 Drawing Sheets

KINETIC BLOWOUT PREVENTER

CROSS-REFERENCE TO RELATED APPLICATIONS

This is a Continuation-in-Part application of U.S. application Ser. No. 18/105,185 filed on Feb. 2, 2023, which is incorporated herein by reference in its entirety.

BACKGROUND

This disclosure relates to the field of blowout preventers. Many devices have been produced to sever objects in bores during normal operations and under emergency conditions. In the oil and gas industry, well control apparatus such as blowout preventers (BOPs) are implemented with "shear rams" which are used to close a BOP when there are tools, pipes, or other objects in a well that prevent ordinary operation of other devices used to close a BOP. The BOPs prevent potentially catastrophic events known as blowouts, where high well pressures and uncontrolled flow from a subsurface formation into the well can expel tubing (e.g., drill pipe and well casing), tools, and drilling fluid out of a well. Blowouts present a serious safety hazard to drilling crews, the drilling rig and the environment and can be extremely costly. Typically BOPs have "rams" that are opened and closed by actuators. The most common type of actuator is operated hydraulically to push closure elements pushed across a through bore in a BOP housing to close the well. In some cases, the rams have hardened steel shears to cut through a drill string or other tool or object which may be in the well at the time it is necessary to close the BOP.

Limitations of many of the hydraulically actuated rams include a requirement for a large amount of hydraulic force to move the rams against the pressure inside the wellbore and subsequently to cut through objects in the through bore. An additional limitation is that the hydraulic force is typically generated at a location away from the BOP (necessitating a hydraulic line from the pressure source to the rams), making the BOP susceptible to failure to close if the hydraulic line conveying the hydraulic force is damaged. Further problems may include erosion of cutting and sealing surfaces due to the relatively slow closing action of the rams in a flowing wellbore. Cutting through tool joints, drill collars, large diameter tubulars and off-center pipe strings under heavy compression also present problems for hydraulically actuated rams. Pyrotechnic based BOPs have been proposed which address many of the shortcomings of hydraulic BOPs such as those described in U.S. Pat. No. 11,028,664 assigned to the present assignee. A need remains for improved cutting devices to shear or sever objects in bores.

SUMMARY

A blowout preventer including a main body having a through bore; an insert having a first segment and a second segment defining a passage between the segments oriented transverse to the through bore; the first segment and the second segment each configured with a plurality of seals to restrict fluid flow from the through bore, wherein each seal is configured for energization; a cutter configured for motion to sever objects in the through bore; a gate configured for motion in the transverse passage; and a charge configured for activation to propel the gate to move the cutter across the through bore.

A blowout preventer including a main body having a through bore; an insert having a first segment and a second segment defining a passage between the segments oriented transverse to the through bore; the first segment and the second segment each configured with a plurality of seals to restrict fluid flow from though bore, wherein each seal is configured for energization; a cutter configured for motion to sever objects in the through bore; and a gate configured for motion along the passage in response to activation of a charge, wherein the gate is configured to move along the passage between a position spaced apart from the cutter to a position where the gate contacts the cutter to move the cutter across the through bore.

A method of operating a blowout preventer having a body with a through bore, including: actuating a charge to propel a gate along a passage in an insert disposed in the body; wherein the insert is configured with a first segment and a second segment defining the passage between the segments to be oriented transverse to the through bore; wherein the gate is propelled from a position spaced apart from a cutter disposed in the passage to a position where the gate contacts the cutter; allowing the propelled gate to move the cutter across the through bore; and energizing a plurality of seals on each of the first segment and the second segment to restrict fluid flow from the though bore.

DETAILED DESCRIPTION

Figure 1:
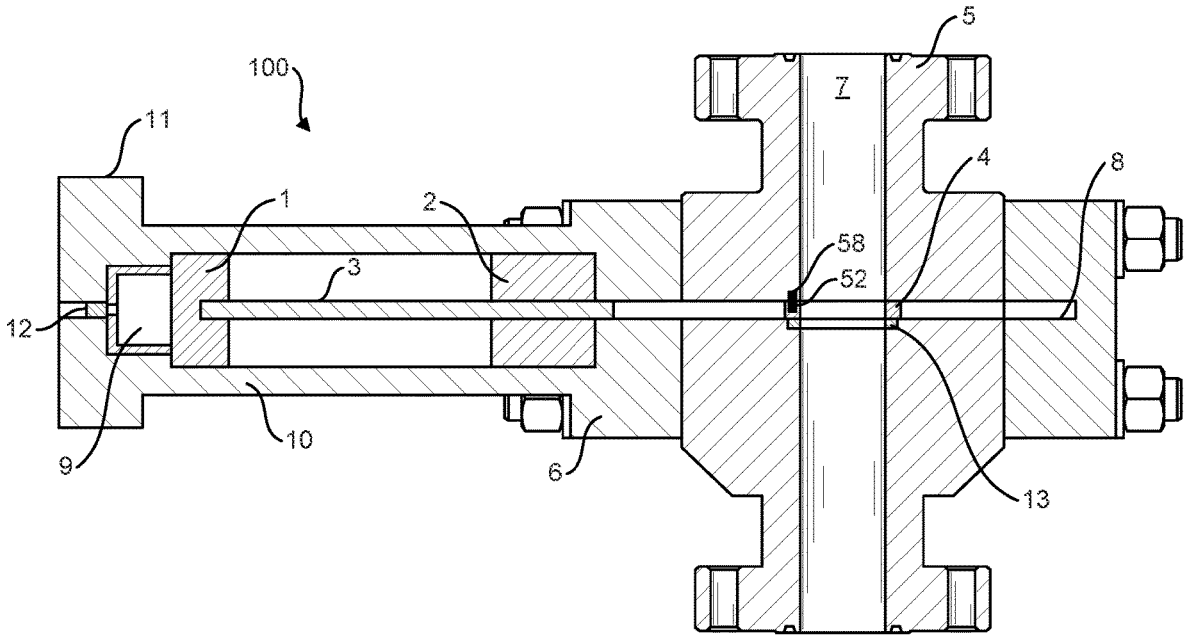
FIG. 1 shows a section view of an example embodiment of a BOP implemented with a cutter according to the present disclosure.

Illustrative embodiments of blowout preventer devices are set forth in this disclosure. The disclosed embodiments are not to be limited to the precise arrangements and configurations shown in the figures and as described herein, in which like reference numerals may identify like elements. In the interest of clarity and conciseness, the figures are not necessarily drawn to scale, and certain features may be shown exaggerated in scale or in generalized or schematic form. As used herein, the word "fluid" is intended to include a gas, a liquid, and/or a combination of the two.

Turning to FIG. 1, there is shown a sectioned elevational view of an example embodiment of a BOP 100 implemented with a cutter. The BOP 100 has a main body 5 having a through bore 7. The BOP 100 also has a passage 8 that is oriented transversely to the through bore 7. A cutter 4 fluidly seals the passage 8, which extends from the through bore 7 into a pressure housing 10. The cutter 4 is positioned inside the main body 5 housing and has an opening (see element 26 in FIG. 2) centered about the through bore 7 prior to actuation of the BOP 100. A cutting edge (defined below) may be formed on the circumference of the opening in the cutter 4. A piston 1 and gate 3 are disposed in the pressure housing 10. The gate may be a substantially flat plate (e.g., made from steel), shaped to enable longitudinal motion along the passage 8 and to act in the same manner as a gate in a gate valve to close the through bore 7 as will be further explained. FIG. 1 also shows the cutter 4 fluidly sealing the passage 8 from the through bore 7. Around the through bore 7, a through bore seal 13 may be disposed below the lower plane of the gate 3, which will be explained in more detail below.

A charge 9, which may be in the form of a heat and/or percussively initiated chemical propellant, is located between the piston 1 and an end cap 11 at the longitudinal end of the pressure housing 10 opposite the main body 5. The charge 9 may be initiated to combust or react to produce high pressure gases, which in turn propel the piston 1, and thus the gate 3 through the pressure housing 10 and into the cutter 4. Kinetic energy from the piston 1 and gate 3 are transferred to the cutter 4 to propel the cutter 4 along the passage 8 and across the through bore 7, in addition, the gate 3 and cutter 4 may remain in intimate contact as they travel across the through bore 7 allowing the force from the expanding gases to continue to act through the piston 1 and gate 3 and onto the cutter 4 during shearing to increase shearing effectiveness.

An arresting mechanism in the form of an energy absorbing element 2 is located inside the pressure housing 10 between the piston 1 and a bonnet 6. The energy absorbing element 2, such as a crushable material is adapted to absorb the kinetic energy of the piston 1 and the gate 3.

Figure 2:
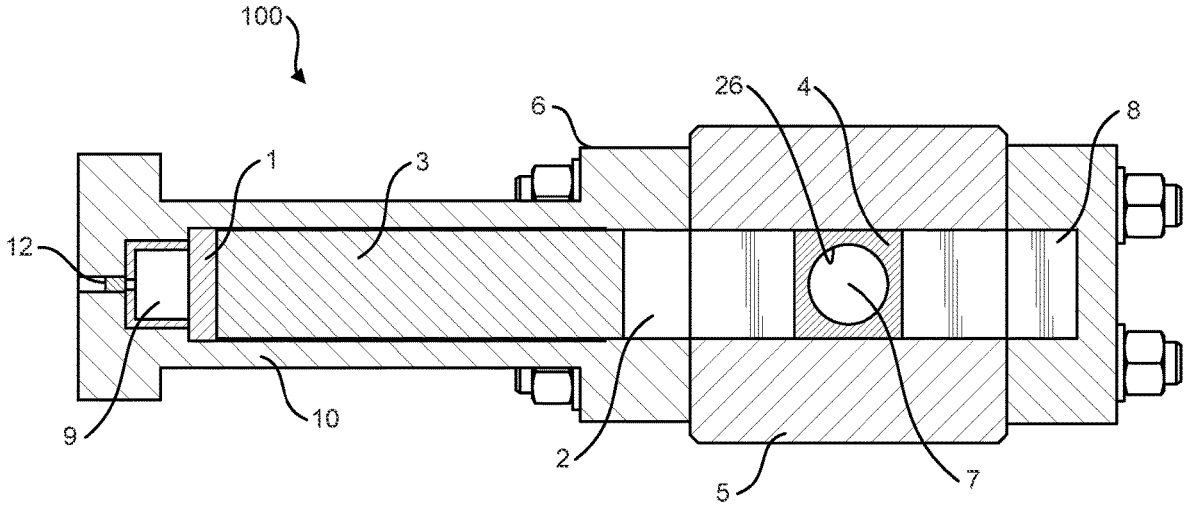
FIG. 2 shows a plan view of an example embodiment of a BOP implemented with a cutter according to the present disclosure.

The operation of the BOP 100 will now be explained with reference to FIG. 2, which is a plan view of a blowout preventer implemented with a cutter according the present disclosure, prior to being activated. As can be observed in FIG. 2, the charge 9, piston 1 and gate 3 are located on a first side of the through bore 7. FIG. 2 also shows an initiator 12 which is adapted to activate the charge 9. The energy absorbing element 2 is located within the passage 8 on the same side of the through bore 7 as the piston 1 and gate 3.

When the initiator 12 is activated, a rapid gas expansion occurs to create a pressure from the charge 9. At this stage, the piston 1 and gate 3 are accelerated along the passage 8 toward the cutter 4 and the through bore 7. Once contact is made between the gate 3 and the cutter 4, kinetic energy is transferred from the piston 1 and gate 3 to the cutter 4, propelling the cutter 4 into the through bore 7. The gate 3 may remain in intimate contact with the cutter 4 as it traverses the through bore 7, adding to the force the cutter 4 is able to impart during shearing. Expanding gases behind the piston 1 may continue to act on the piston 1 during shearing as the cutter 4 traverses the through bore 7. Thus, additional force is provided by kinetic energy from the piston 1 and gate 3. The cutter 4 will shear any wellbore tubulars, tools, or other objects which are present in the through bore 7.

Figure 3:
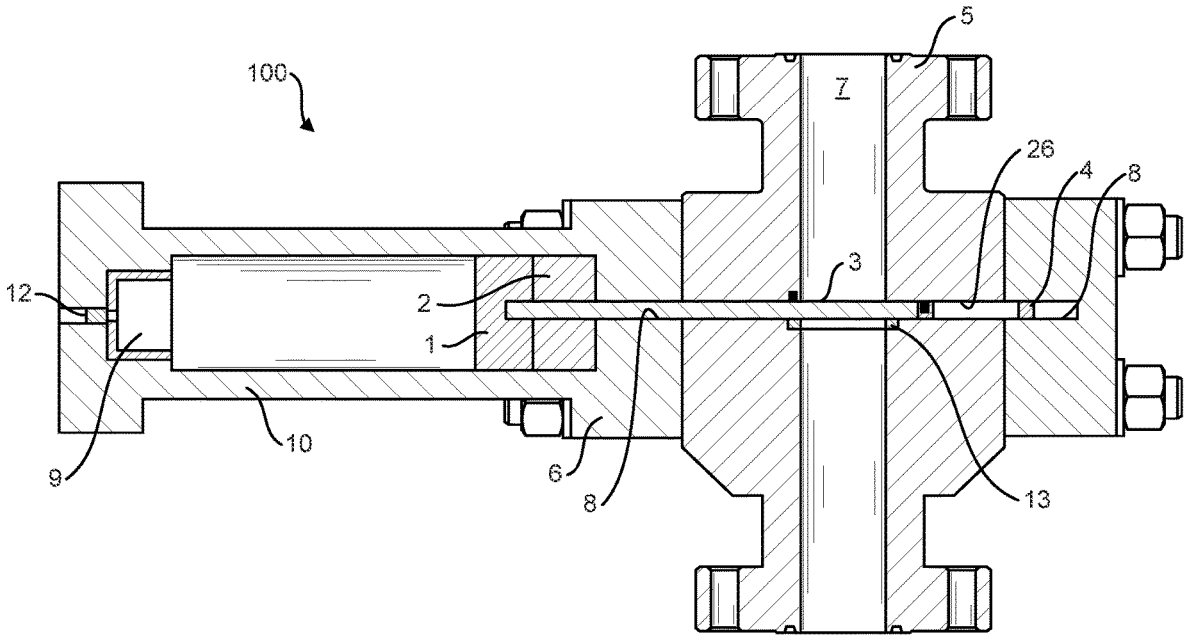
FIG. 3 shows a section view of an example embodiment of a BOP implemented with a cutter according to the present disclosure.

FIG. 3 shows a cross section view of a BOP 100 implemented with a cutter according the present disclosure. At the stage where the gate 3 has propelled the cutter 4 through the through bore 7, the cutter has sheared through any object located in the through bore. The body of energy absorbing material of the energy absorbing element 2 has crumpled to a predetermined amount, absorbing the kinetic energy of the piston 1 and the gate 3. With the BOP 100 embodiment of FIG. 1, the gate 3 will then be substantially aligned with the seal 13. When such alignment occurs, the seal 13 will laterally press against a sealing face (not shown) on the gate 3, to stop the flow of well fluids through the through bore 7, thereby securing the well. Once the well is secured, well fluid pressure control operations can commence. Once well fluid pressure control has been re-established, the BOP 100 can be reopened, such as by retracting the gate 3 to open the through bore 7.

Figure 4:
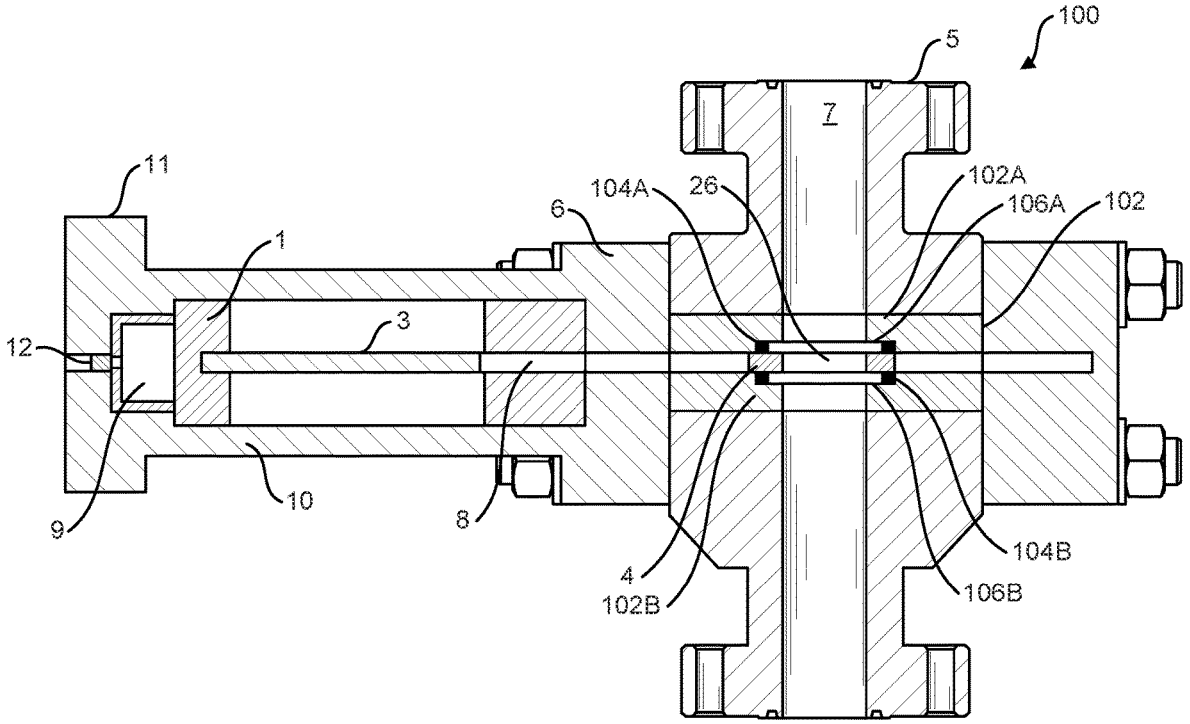
FIG. 4 shows a section view of another example embodiment of a BOP implemented with a cutter according to the present disclosure.

FIG. 4 shows a cross section view of another BOP 100 implemented with a cutter according the present disclosure. In this embodiment, a modular insert 102 is disposed in the main body 5 to provide closure between the through bore 7 and the passage 8. The insert 102 provides effective closure such that fluid pressure in the through bore 7 is excluded from the passage 8. A cutter 4 is positioned in the passage 8 within the main body 5 housing. The insert 102 comprises a pair of annular seals 104A, 104B. One seal 104A is mounted in a channel 106A formed on a first insert segment 102A. The other seal 104B is mounted in a channel 106B formed on a second insert segment 102B. The seals 104A, 104B are respectively disposed on the insert segments 102A, 102B such that a top surface of each seal faces the passage 8 (i.e., transverse to the through bore 7). The seals 104A, 104B are positioned on the insert 102 such that the central opening of each seal 104A, 104B is concentric with the through bore 7. The modular insert 102 is easily replaceable to ensure effective sealing integrity between the through bore 7 and the passage 8.

Figure 5:
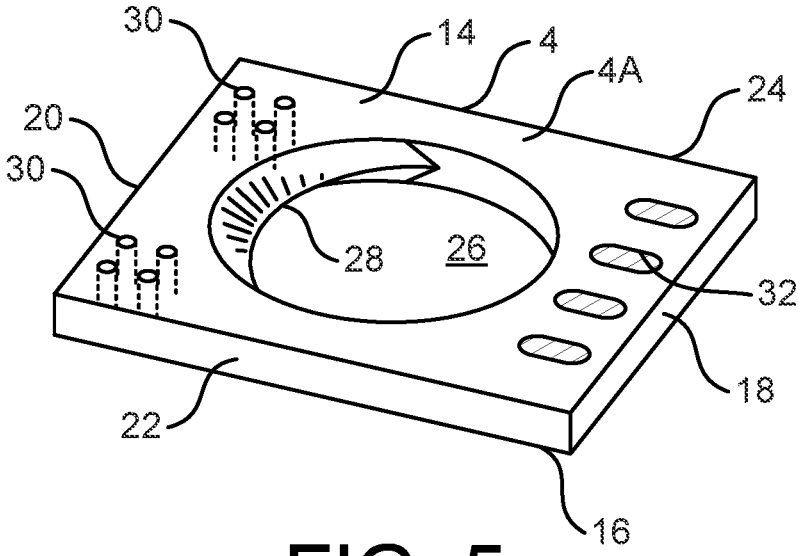
FIG. 5 shows an oblique view of an example embodiment of a cutter according to the present disclosure.

FIG. 5 shows a perspective view of an example embodiment of a cutter 4. The cutter 4 may be formed generally as a quadrilateral planar body 4A, with a top surface 14, a bottom surface 16, a front end 18, and a back end 20. In this embodiment, the cutter 4 is configured in a generally rectangular shape with the front end 18, back end 20, and both sides 22, 24 having planar surfaces. An opening 26 formed generally as an ellipse or oval traverses the cutter 4 from the top surface 14 through to the bottom surface 16 interior of all of the front end 18, back end 20 and both sides 22, 24 and approximately at its center. A cutting edge 28 is formed on the circumference of the opening 26 proximate the back end 20 of the cutter 4. Some embodiments may also be configured with one or more holes 30 and/or voids 32 formed in the cutter body 4A. Such holes 30 or voids 32 may provide a negative space, which lightens the cutter 4 and reduces momentum when the gate (3 in FIG. 1) engages with the cutter 4 as described herein. The holes 30 and voids 32 may be distributed about the cutter 4 in any configuration as desired. When the cutter 4 shown in FIG. 5 is positioned inside a housing (e.g., the main body 5 in FIG. 1), the cutter's 4 back end 20 is positioned to face the gate 3 member (see FIG. 1).

Figure 6:
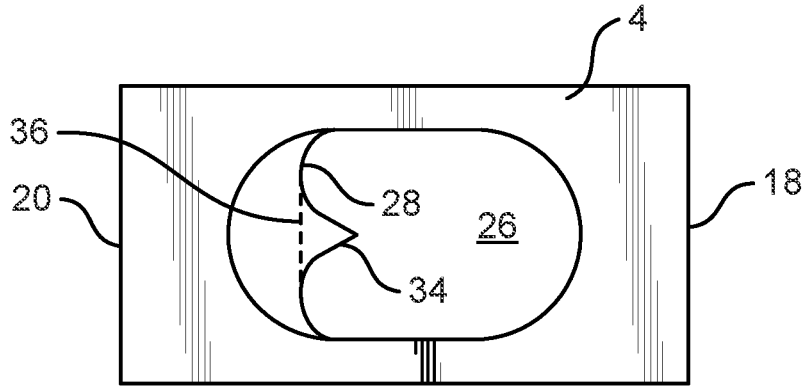
FIG. 6 shows a top view of an example embodiment of a cutter according to the present disclosure.

FIG. 6 is a plan view of another example embodiment of a cutter 4 wherein the cutting edge 28 may be formed in a half-moon or crescent shape. The cutting edge 28 in the cutter 4 embodiment of FIG. 6 is configured with a projection 34 extending from the central portion of the cutting edge 28 surface to form a tip. In some embodiments, the cutting edge 28 with the projection 34 may be formed as a single piece. In other embodiments, the projection 34 may be formed from a different material than the rest of the cutting edge 28. For example, the cutting edge 28 may be formed as a steel cutting edge with a projection or other attached structure made from a metal carbide such as tungsten carbide (e.g., at 28A in FIG. 7) or it may be made from the same material as its substrate and covered or coated with such hard material as metal carbide (e.g., tungsten), or other hard material as known in the art. In such embodiments, the projection 34 may be affixed to the cutting edge 28 using any suitable technique as known in the art (e.g., via brazing, welding, mechanically attached, etc.). In FIG. 6, the projection 34 is shown affixed to the cutting edge 28 along a contact surface 36. Any of the cutter 4 embodiments according to the present disclosure may be implemented with the cutting edge 28 having one or more projections extending from the surface in various configurations.

Figure 7:
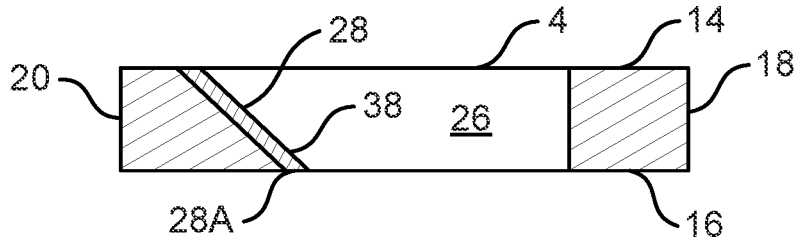
FIG. 7 shows a side view of an example embodiment of a cutter according to the present disclosure.
Figure 8:
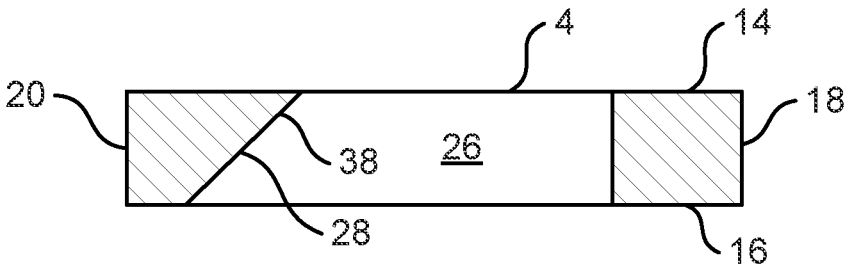
FIG. 8 shows a side view of an example embodiment of a cutter according to the present disclosure.
Figure 9:
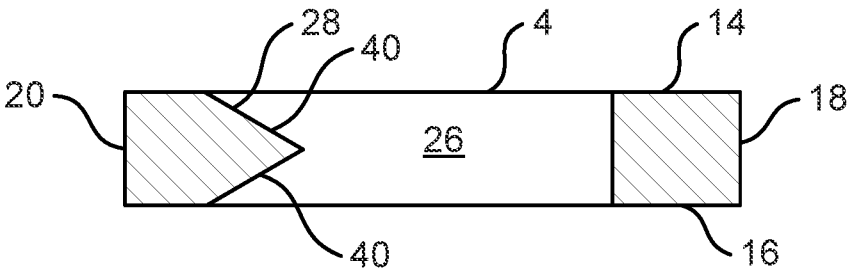
FIG. 9 shows a side view of an example embodiment of a cutter according to the present disclosure.

In some embodiments, the cutting edge 28 may be configured as a sloped ramp with a leading edge 38 extending upward from the bottom surface 16 toward the top surface 14 and back end 20 of the cutter 4, as shown in cross-section in FIG. 7. In some embodiments, the cutting edge 28 may be configured as a sloped ramp with a leading edge 38 extending downward from the top surface 14 toward the bottom surface 16 and back end 20 of the cutter 4, as shown in cross-section in FIG. 8. In some embodiments, the cutting edge 28 is configured with inclined faces 40 extending inward toward the center of the opening 26 in an arrowhead configuration, as shown in cross-section in FIG. 9. Some embodiments may be implemented with the inclined faces 40 having tapers respectively angled at approximately 10-20 degrees from the top surface 14 and the bottom surface 16 of the cutter 4 body.

FIG. 7 also shows, as explained with reference to FIG. 6, a hard material 28A, which may be made from a wear-resistant material such as metal carbide (e.g., tungsten carbide) or "super hard" material such as cubic boron nitride or polycrystalline diamond. The hard material 28A may be in the form of a coating on a substrate, that is a coating on the cutting edge 28 itself, or the hard material 28A may be a separate structure affixed to the substrate, i.e., the cutting edge 28. The hard material 28A may also be formed as one or more layers deposited onto the cutter 4 body via conventional techniques as known in the art. The structure of the hard material 28A shown in FIG. 7 is only one example of a hard material forming part of the surface of the cutting edge 28 that first comes into contact with an object disposed in the through bore (7 in FIG. 1) when the BOP 100 is actuated.

Figure 10:
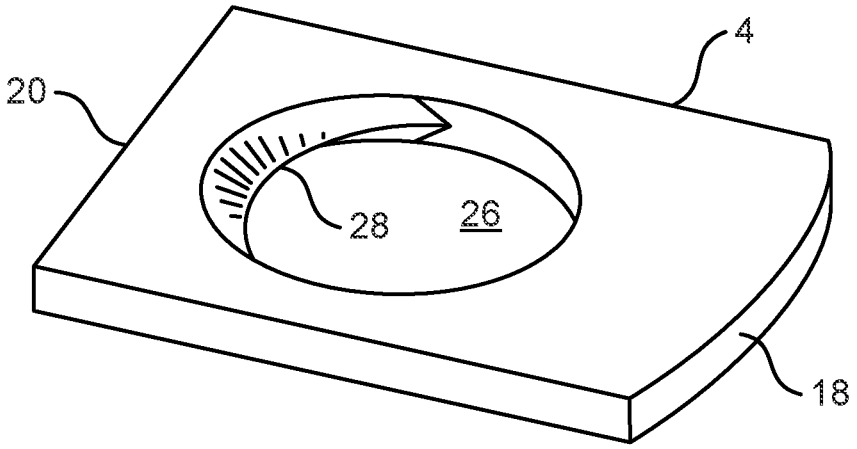
FIG. 10 shows an oblique view of an example embodiment of a cutter according to the present disclosure.
Figure 11:
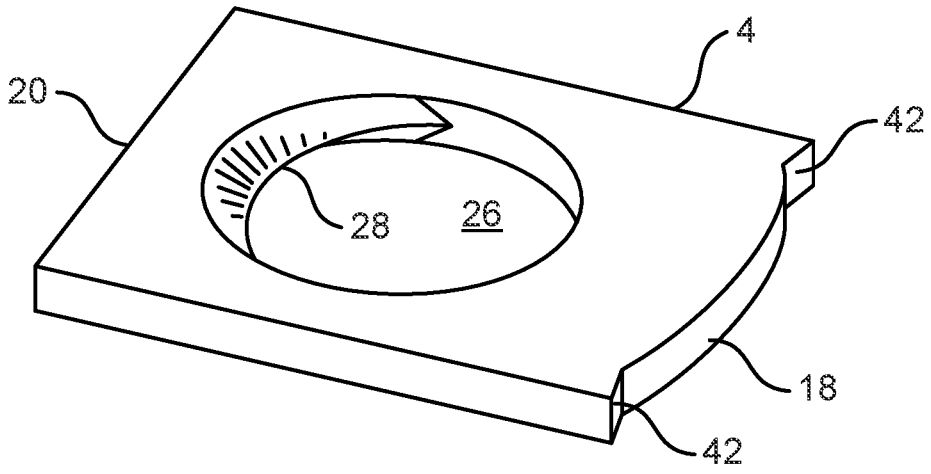
FIG. 11 shows an oblique view of an example embodiment of a cutter according to the present disclosure.

FIG. 10 shows a perspective view of another example embodiment of the cutter 4. In this embodiment, the front end 18 may be configured with a curved or rounded surface. In this embodiment the curved surface comprises a single curvature. FIG. 11 shows a perspective view of another example embodiment of the cutter 4. In this embodiment, the front end 18 is partially curved near the central region, with a planar indent 42 formed on each side of the curved surface.

Figure 12:
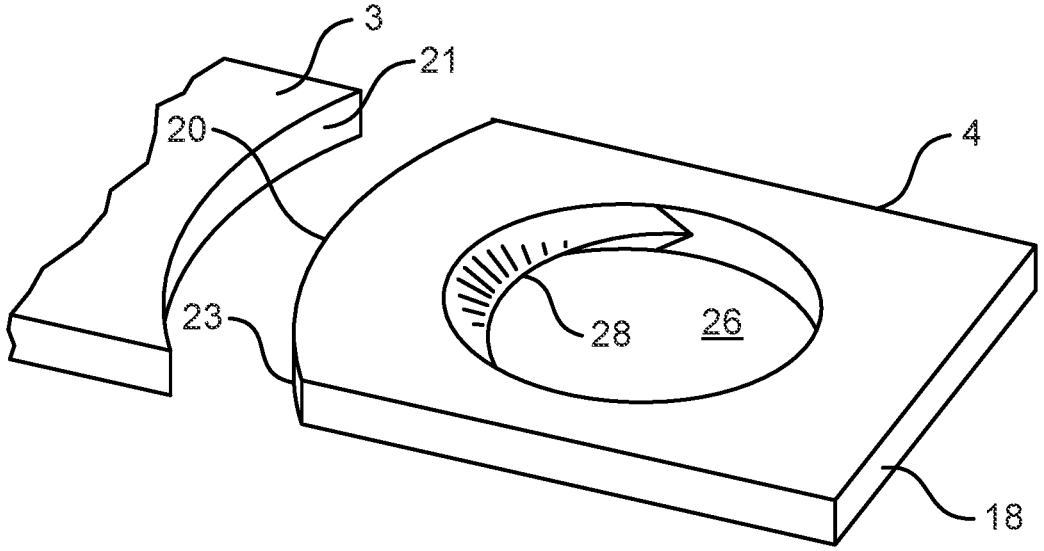
FIG. 12 shows an oblique view of an example embodiment of a cutter according to the present disclosure.

FIG. 12 shows another example embodiment of a cutter 4 configured with a rounded or curved back end 20. With such embodiments, the gate 3 member end facing the cutter 4 may be configured with a curved or rounded surface 21 to engage with a matching curved surface 23 on the back end 20 of the cutter 4 as described herein. Although the cutter 4 embodiments depicted in the figures of this disclosure are shown configured with convex curved or rounded ends, it will be appreciated that any of the cutter embodiments may be implemented with concave curved or rounded ends and matching convex-end gate members (not shown).

Figure 13:
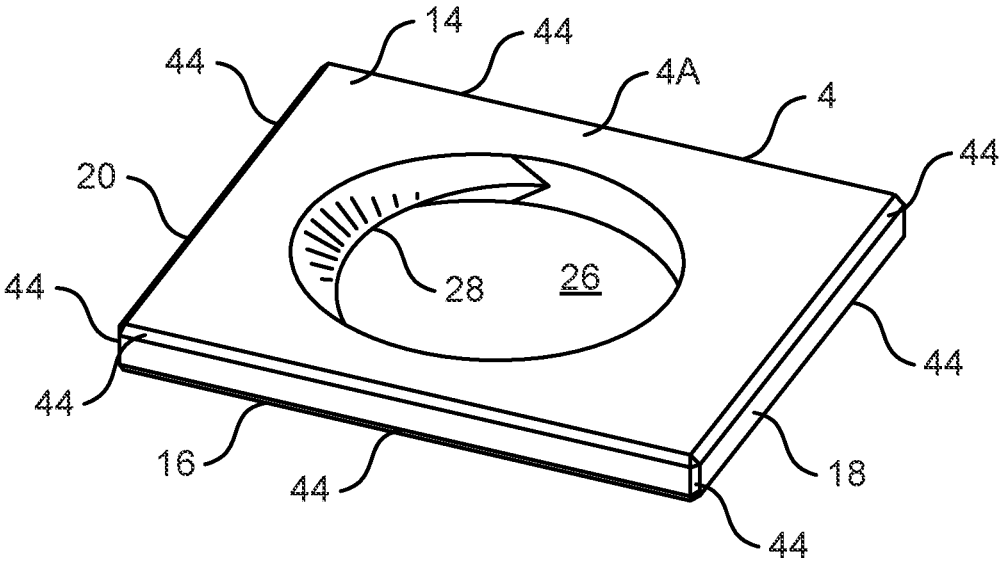
FIG. 13 shows an oblique view of an example embodiment of a cutter according to the present disclosure.

FIG. 13 shows a perspective view of another example embodiment of the cutter 4. In this embodiment, all sides of the cutter body 4A may be configured with a slight bevel 44 running along the periphery of each of the upper surface 14, lower surface 16, and corresponding ends 18, 20.

Figure 14:
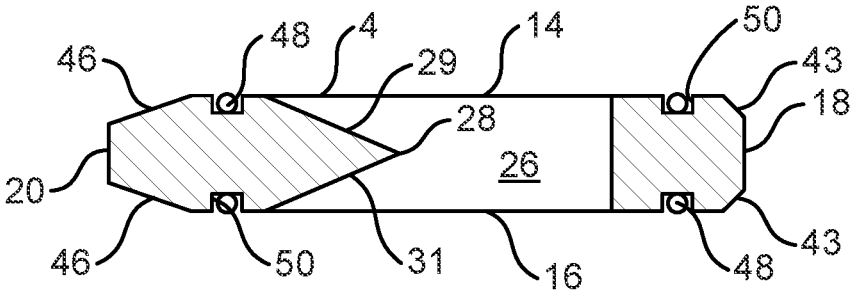
FIG. 14 shows a side view of an example embodiment of a cutter according to the present disclosure.

FIG. 14 shows a cross section of another example embodiment of a cutter 4 that may be configured with extended-slope edge tapers 46 formed at the back end 20 and defined between the back end 20 and the upper 14 and lower 16 surfaces. The front end 18 may comprise the same tapers as or shorter tapers 43 as compared to the corresponding back end 20 edge tapers 46. The embodiment of FIG. 14 may also be configured with upper and lower seals 48 disposed in corresponding grooves or channels 50 formed in the top 14 and bottom 16 surfaces of the cutter body. Any suitable conventional seals may be used as known in the art (e.g., O-rings, composite seals, spring-energized seals, etc.). When the cutter 4 is positioned inside the main body 5 housing, the seals 48 fluidly seal the passage 8 from the through bore 7 (see FIG. 1). The cutting edge 28 in some embodiments may comprise an upper tapered surface 29 and a lower tapered surface 31 converging between the top surface 14 and the bottom surface 16. In the present embodiment, the upper tapered surface 29 and the lower tapered surface 31 may subtend the same angle with reference to the top 14 and bottom 16 surfaces. In some embodiments, as will be explained with reference to FIG. 15, the tapered surfaces 29, 31 may subtend different angles.

Figure 15:
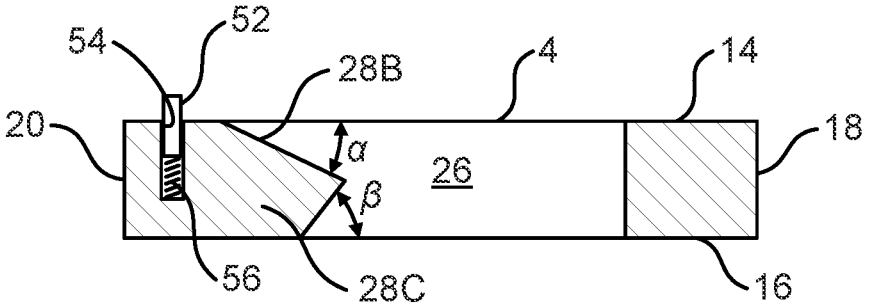
FIG. 15 shows a side view of an example embodiment of a cutter according to the present disclosure.

FIG. 15 shows a cross section of another example embodiment of a cutter 4 wherein the cutting edge 28 may be formed with one surface 28B tapered at a selected angle $\alpha$ with respect to the top surface 14 and the other surface 28C at an angle $\beta$ with respect to the bottom surface 16. Some embodiments may also be configured with a shearable pin 52 disposed in an orifice 54 formed on the cutter 4 body, e.g., in the top surface 14 as shown in FIG. 14, or in the bottom surface 16. The shearable pin 52 may be urged in a direction away from the respective surface 14, 16 using a biasing device such as a spring 56, loaded to retract and extend from the orifice 54. In such an embodiment, the shearable pin 52 can engage with a notch 58 aligned in the main body 5 (see embodiment of FIG. 1) to receive the shearable pin to hold the cutter 4 in place until the gate 3 engages with the cutter 4 as described herein.

Figure 16:
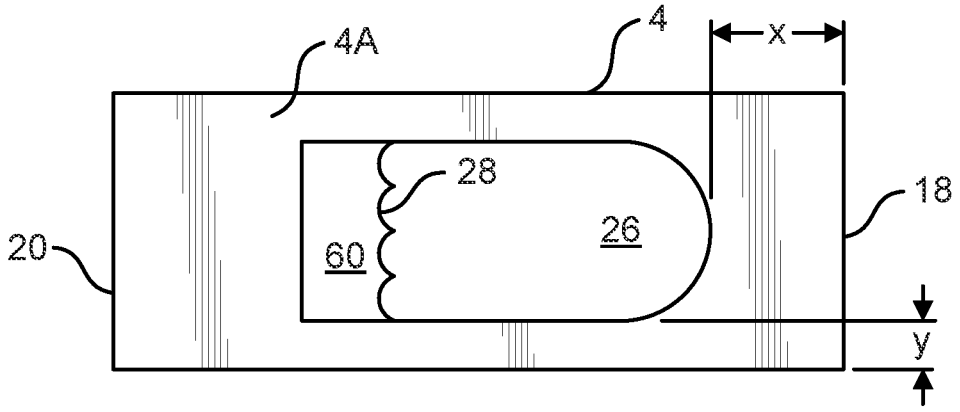
FIG. 16 shows a top view of an example embodiment of a cutter according to the present disclosure.

FIG. 16 shows a plan view of another example embodiment of a cutter 4. In this embodiment, the cutting edge 28 may be configured with multiple tips, forming a serrated leading edge. In some embodiments, the cutter 4 may also be configured as a multi-piece unit. For example, the cutter 4 in FIG. 16 is shown as having a separate cutting insert 60 disposed in the opening 26 and affixed to the cutter body (e.g., such as by brazing, welding, mechanically attaching, etc.) to form the cutting edge 28. As shown in FIG. 16, some embodiments may also be configured with thinner side walls (depicted in the y-axis) surrounding the opening 26 compared to the cutter body 4A wall forming the front and/or back of the cutter (depicted in the x-axis).

Figure 17:
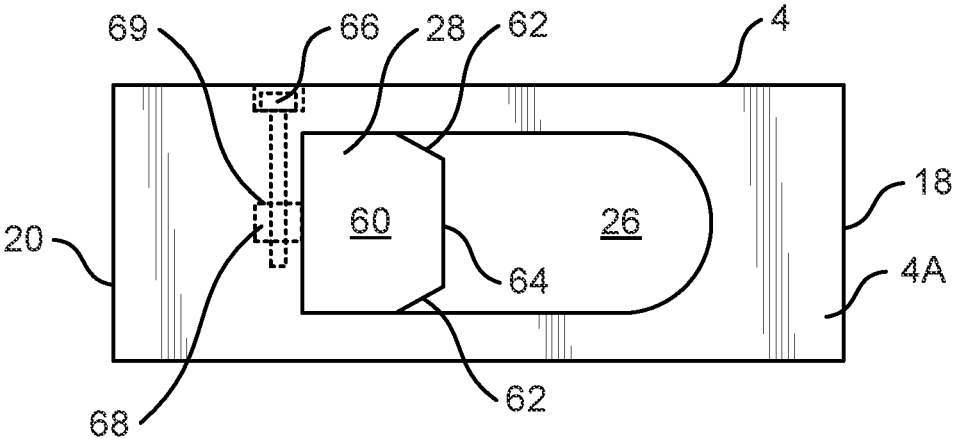
FIG. 17 shows a top view of an example embodiment of a cutter according to the present disclosure.

FIG. 17 shows a plan view of another example embodiment of the cutter 4. In this embodiment, the cutting edge 28 may be configured with linear sides 62 and a flat front portion 64. Some embodiments may also be configured with a separate cutting insert 60 disposed in the opening 26 and mechanically affixed to the cutter body 4A using e.g., a bolt 66 inserted from the side of the cutter body to engage with a stem 68 extending from the back side of the insert 60 into a port 69 formed in the opening 26 in the cutter body 4A.

Figure 18:
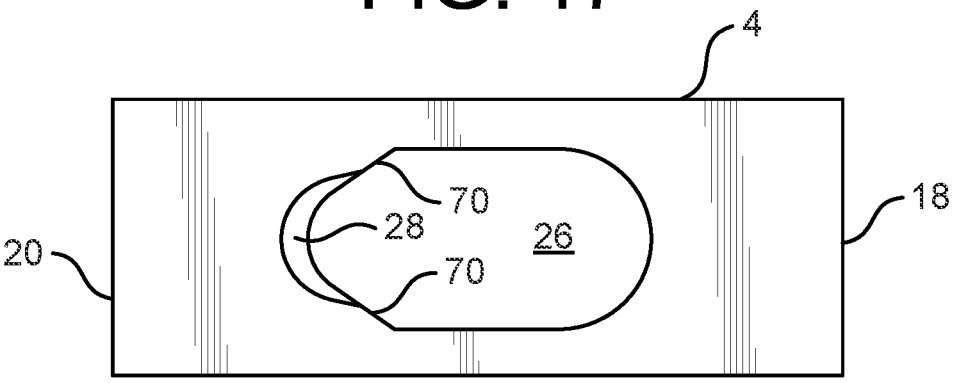
FIG. 18 shows a top view of an example embodiment of a cutter according to the present disclosure.

FIG. 18 shows a plan view of another example embodiment of the cutter 4. In this embodiment, the opening 26 may be formed with angled side chamfers 70 extending from the cutting edge 28 side ends towards the center of the opening 26. The side chamfers 70 aid in centering and guiding an object in the through bore (7 in FIG. 1) to abut with the cutting edge 28 when the cutter 4 is engaged by the gate (3 in FIG. 1) as described herein.

Figure 19:
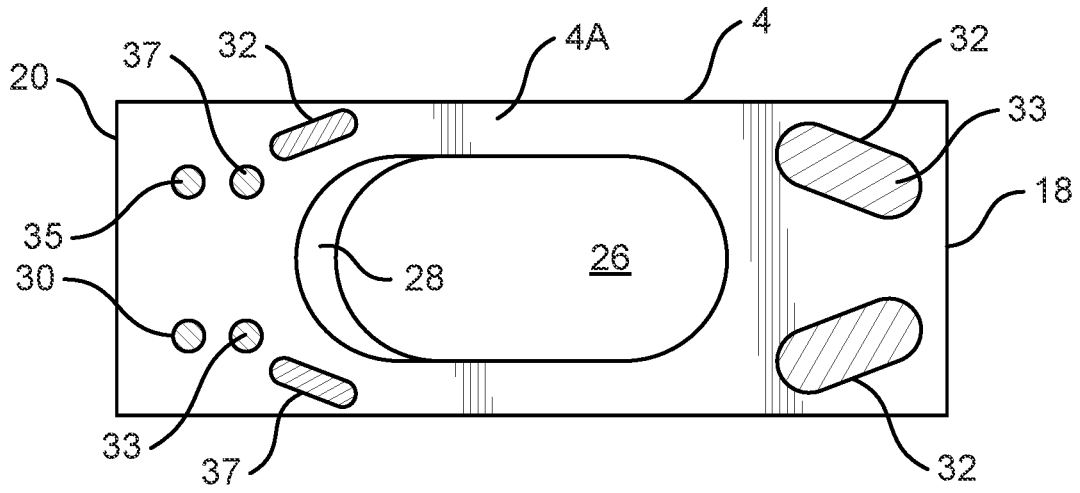
FIG. 19 shows a top view of an example embodiment of a cutter according to the present disclosure.

FIG. 19 shows a plan view of another example embodiment of the cutter 4. In this embodiment, the cutter body 4A may be configured with one or more holes 30 and/or voids 32, similar to the embodiment of FIG. 5. However, in this embodiment the holes 30 and/or voids 32 may be filled with any suitable material 33 (e.g., composites, metals, plastics, ceramics, etc.), preferably a material which is lighter than original material of the cutter body 4A. The holes 30 and voids 32 may be distributed about the cutter 4 in any configuration as desired. In some embodiments, the holes 30 and/or voids 32 may be filled with a suitable liquid 35 and sealed via techniques known in the art. In some embodiments, the holes 30 and/or voids 32 may be filled with liquids encapsulated in capsule-type or ball-type enclosures 37 as known in the art. These configurations reduce momentum when the gate member (3 in FIG. 1) engages with the cutter 4 as described herein. These configurations also aid to attenuate shock waves that may traverse the cutter body 4A as a result of the force imparted on the cutter when the gate 3 member impacts the cutter as described herein.

Figure 20:
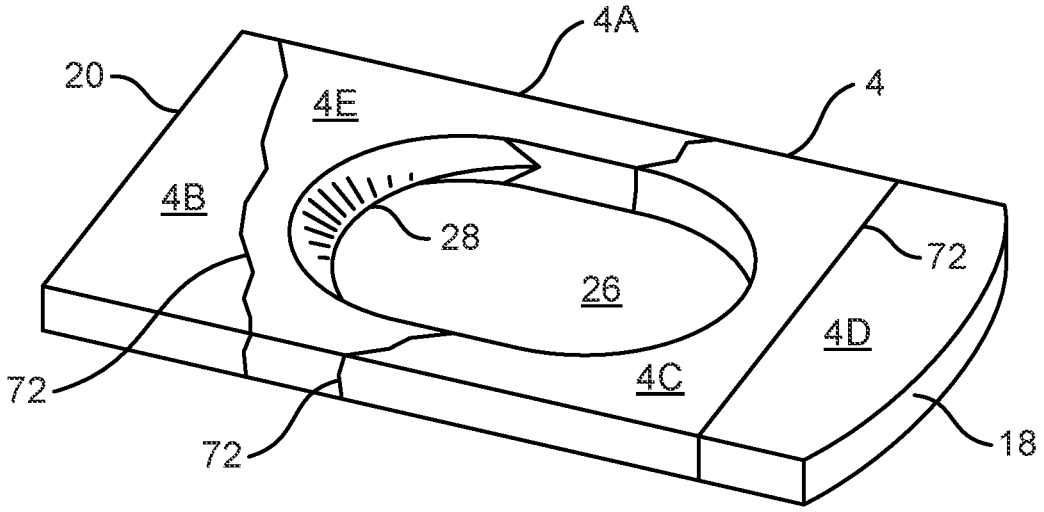
FIG. 20 shows an oblique view of an example embodiment of a cutter according to the present disclosure.

FIG. 20 shows a perspective view of another example embodiment of a cutter 4. In this embodiment, the cutter body 4A is formed as a multi-piece 4B, 4C, 4D, 4E structure. FIG. 20 shows different junction lines 72 where the various body 4A pieces are united to form the cutter 4. The pieces can be affixed together using techniques as known in the art (e.g., brazing, welding, etc.). As shown by the junction lines 72 in FIG. 20, the cutter 4 pieces may be configured to join one another forming linear or non-linear junctions. The implementation of embodiments with non-linear junctions aids to attenuate shock waves that may traverse the cutter body 4A as a result of the force imparted on the cutter when the gate 3 member impacts the cutter as described herein. With multi-piece embodiments, different types of materials may be used to form the individual sections (e.g., 4B, 4C, 4D, 4E in FIG. 20) forming the cuter 4. For example, the section 4D forming the front end 18 in FIG. 20 may be formed from a lighter metal compared to the sections forming the central 4C, 4E or back end 20 portions 4B of the cutter 4.

Figure 21:
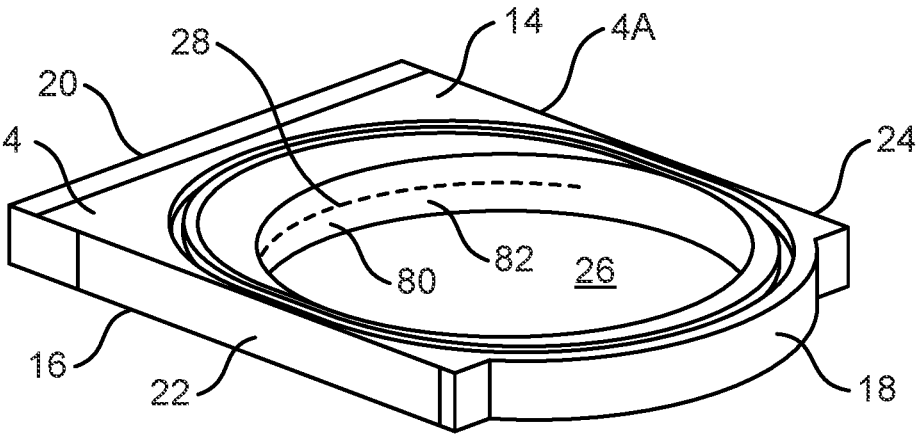
FIG. 21 shows an oblique view of an example embodiment of a cutter according to the present disclosure.

FIG. 21 shows a perspective view of another example embodiment of the cutter 4. The cutter 4 may be formed generally as a quadrilateral body 4A having flat planar surfaces with a front end 18, a back end 20, a top surface 14, a bottom surface 16, and two sides 22, 24. The cutting edge 28 may be formed on the circumference of the opening 26, which traverses the cutter 4 from the top surface 14 through to the bottom surface 16. The cutting edge 28 extends outward from the back end 20 toward the center of the opening 26. The cutting edge 28 may be formed in any configuration as described herein. As shown in FIGS. 1-2, prior to activation of the charge 9, the cutter 4 opening 26 is positioned in coaxial alignment with the through bore 7. Therefore, in operation the cutter 4 cutting edge 28 is exposed to fluids and materials (e.g., drilling mud, formation cuttings, etc.) traversing the through bore 7 and past the cutter 4. Such material movement may cause fouling and damage to the cutting edge 28.

As shown in FIG. 21, cutter 4 embodiments may be configured with a protective layer 80 disposed over the cutting edge 28. The protective layer 80 covers and seals the cutting edge 28. The protective layer 80 may be disposed to form a planar face 82 along the inner diameter of the opening 26. The protective layer 80 may be applied via well-known techniques, using conventional materials and compounds (e.g., resilient materials) to form the protective layer as known in the art (e.g., epoxies, elastomers such as rubber and polyurethane, ceramics, thermoplastics and the like).

Figure 22:
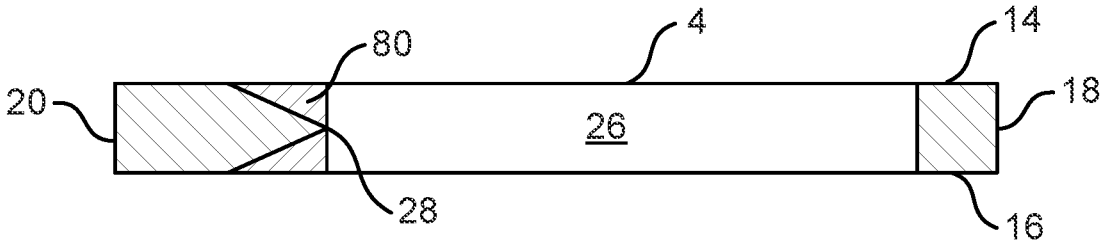
FIG. 22 shows a side view of the cutter of FIG. 21.

FIG. 22 shows a cross section of the cutter 4 of FIG. 21, wherein the protective layer 80 is dispose on the cutter so as to cover the cutting edge 28. In this example embodiment, the protective layer 80 forms a protective cap over the cutting edge 28, thereby shielding the cutting edge from fluids, debris and other materials in or flowing through the bore (7 in FIG. 1). When the charge 9 is activated, gas pressure propels the gate member (3 in FIG. 1), and subsequently the cutter 4, along the passage (8 in FIG. 1) at a very high rate of speed. As the cutter 4 is propelled across the bore 7, the protective layer 80 makes first contact with any object in the bore. The protective layer 80 will give way to the cutting edge 28 of the cutter 4, allowing the cutter then to shear through the object in the bore 7. Although a subset of the cutter 4 embodiments of this disclosure are shown with a protective layer 80, it should be understood that any and all cutter 4 embodiments may be configured with a protective layer 80.

Figure 23:
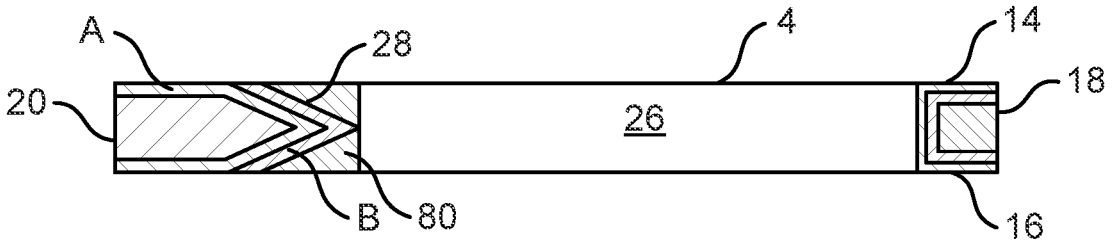
FIG. 23 shows a side view of an example embodiment of a cutter according to the present disclosure.

FIG. 23 shows another example cutter 4 embodiment. In some embodiments, one or more layers A, B of coatings may be applied to the cutting edge 28 to provide increased wear resistance, corrosion resistance, anti-galling, etc. Conventional materials may be used to form the coating(s) A, B as known in the art. For example, some embodiments may be implemented with a cutting edge 28 overlain with a first coating A, formed using a ceramic coating sold under product designation Tech 12, and a second coating B over the first coating A, formed using a ceramic coating sold under product designation Tech 22, both of which products are made by Bodycote PLC, Springwood Court, Springwood Close, Tytherington Business Park, Macclesfield, Cheshire, United Kingdom SK10 2XF. Some embodiments may be implemented with Tech 12 or Tech 22 ceramic coating applied to the cutting edge 28 and heat treated, such as in an oven. Repetition of this process may be implemented to produce coatings A, B that are substantially free from porosity. Implementation of some ring cutter 4 embodiments may comprise coatings over the entire surface of the ring cutter 4, which may provide a fully inert exterior surface that can protect against hydrogen embrittlement and sulfide stress cracking. In some embodiments, a very hard substrate may be used to form the body 4A of the cutter 4. In some embodiments, the protective layer 80 may be applied over the one or more coatings A, B.

Figure 24:
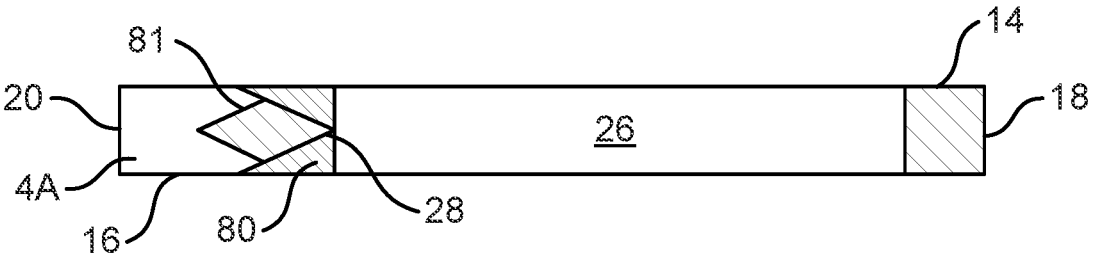
FIG. 24 shows a side view of an example embodiment of a cutter according to the present disclosure.

FIG. 24 shows a cross section of another example cutter 4 embodiment. In this embodiment, a shaped insert 81 may be affixed to the substrate forming the body 4A. The insert 81 may be tapered to form a cutting edge 28. The insert 81 may be formed from a different material than the cutter body 4A. For example, in some embodiments the cutter body 4A may be formed from a corrosion resistant material (e.g., INCONEL alloy. INCONEL is a registered trademark of Huntington Alloys Corp., Huntington, WV.), and the insert 81 may be made from a high strength/hardness material (e.g., metal carbide such as tungsten carbide, ceramics, cubic boron nitride, etc.). In such embodiments, the insert 81 may be affixed to the cutter body 4A using any suitable technique as known in the art (e.g., via brazing, welding, mechanically attached, etc.). As with other embodiments disclosed herein, a protective layer 80 may be disposed over the cutting edge 28, for example, to form a planar face (see 82 in FIG. 21) along the inner diameter surface of the opening 26.

Figure 25A:
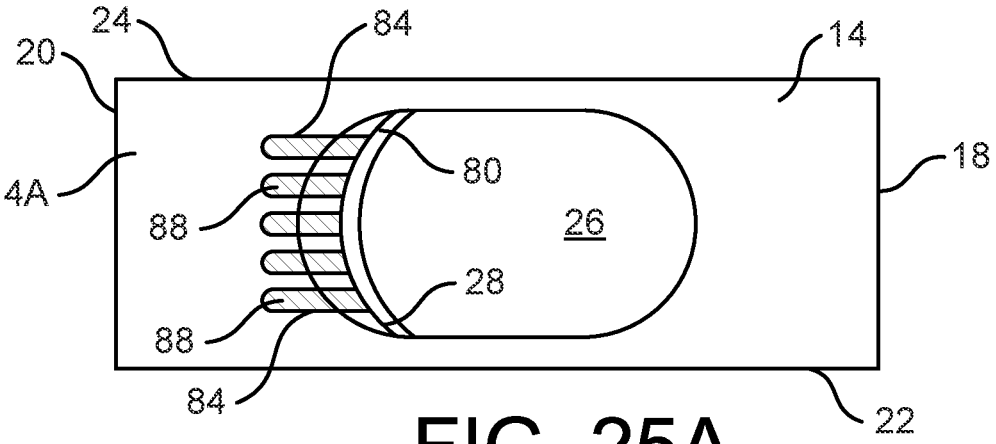
FIG. 25A shows a top view of an example embodiment of a cutter according to the present disclosure.
Figure 25B:
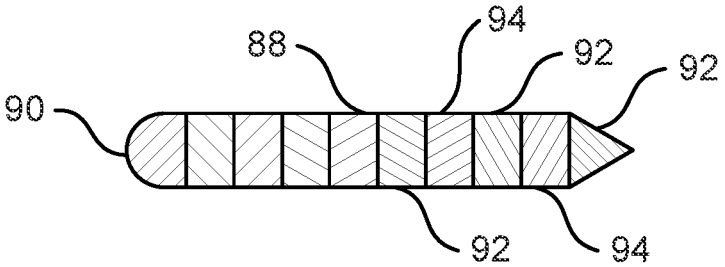
FIG. 25B shows a cross-section of a void, with a layered composition insert formed via interspersed elements filling the void.

FIG. 25A is a plan view of another example cutter 4 embodiment. In this embodiment, the cutter body 4A includes one or more voids 84 containing a layered composition forming an insert 88. FIG. 25B shows a cross section of one such layered composition insert 88 formed via interspersed elements 90 used to fill the void. In some embodiments, the elements 90 may include a series of hard, high strength materials 92 (e.g., ceramics, and the like) interleaved with other materials 94 (e.g., the material used to form the cutter body 4A such as described with reference to FIG. 24). The individual elements 90 may be inserted and pressed into the voids 84 via conventional techniques as known in the art. In some embodiments, the void(s) 84 may be added after the cutter body 4A is formed with a cutting edge 28. For such embodiments, the voids 84 may be formed by drilling out the body 4A from the opening 26 toward the back end 20.

Figure 26:
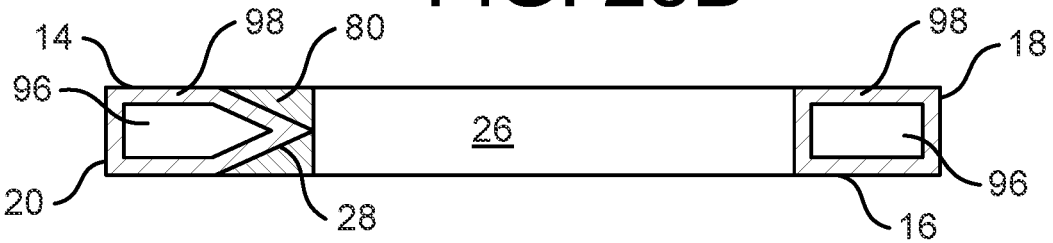
FIG. 26 shows a side view of an example embodiment of a cutter according to the present disclosure.

FIG. 26 shows another example cutter 4 embodiment. In some embodiments, the cutter 4 may be formed with an inner core 96 encapsulated by one or more layers forming an exterior coating 98. In some embodiments, the inner core 96 may comprise a high-strength, non-corrosion resistant material (e.g., steel and other metal alloys). Exterior coatings 98 may comprise a lower-strength, corrosion resistant material (e.g., and without limitation, inorganic zinc, polyphenylene sulfide/RYTON synthetic resin; RYTON is a registered trademark of Solvay, SA, Rue de Ransbeek 310 Brussels, Belgium B-1120). Other cutter 4 embodiments with configurations such as depicted in FIG. 26 may also be implemented with an inner core 96 formed of a high-strength, hardened material (e.g. INCONEL 718 alloy; INCONEL 718 is a registered trademark of Huntington Alloys Corp.) and encapsulated by one or more layers forming an exterior coating 98. In some embodiments, the exterior coating 98 may be treated to harden the surface and improve corrosion resistance using conventional techniques as known in the art (e.g., via annealing, electron beam welding, etc.). As discussed with respect to other embodiments disclosed herein, layered embodiments may be formed via HIP techniques as known in the art. For example, a cutter 4 assembly may be configured via HIP processing using a suitable powder matrix to implement the layering. Embodiments may also be implemented with a protective layer 80 disposed over the exterior coating 98 to provide additional protection to the cutting edge 28 if desired.

The cutter 4 embodiments of this disclosure may be formed from any suitable materials as known in the art. Some embodiments may be formed from suitable metals or metallic alloys (e.g., metal carbide such as tungsten carbide). The cutters 4 may be formed using conventional manufacturing techniques as known in the art (e.g., forging, machining processes, 3D printing, etc.). Some embodiments may also be implemented with the cutting edge 28 surfaces having specialized coatings or compositions (e.g., infused with or coated with polycrystalline diamond, cubic boron nitride or other known "super hard" materials) as described herein.

An advantage of a BOP configured according to the present disclosure is that the blowout preventer can be actuated without having to produce hydraulic forces to hydraulically push rams into the through bore to cut objects therein. Instead, the energy required to sever the objects and close the wellbore is contained in the charge in the blowout preventer where it is required. Another advantage of having the cutter 4 fluidly sealing the passage 8 from the through bore 7 is that the gate 3 member can accelerate along the passage 8 unhindered by well fluids or other liquids until the member contacts the cutter 4.

Figure 27:
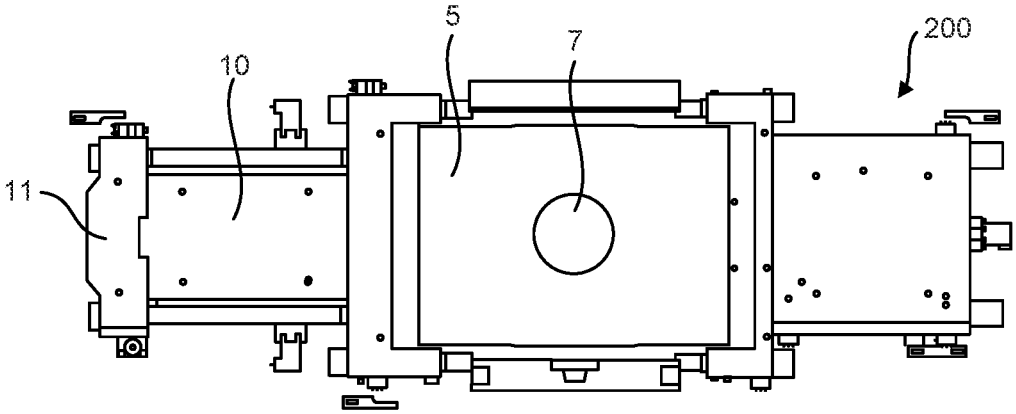
FIG. 27 shows a plan view of an example embodiment of a BOP according to the present disclosure.
Figure 28:
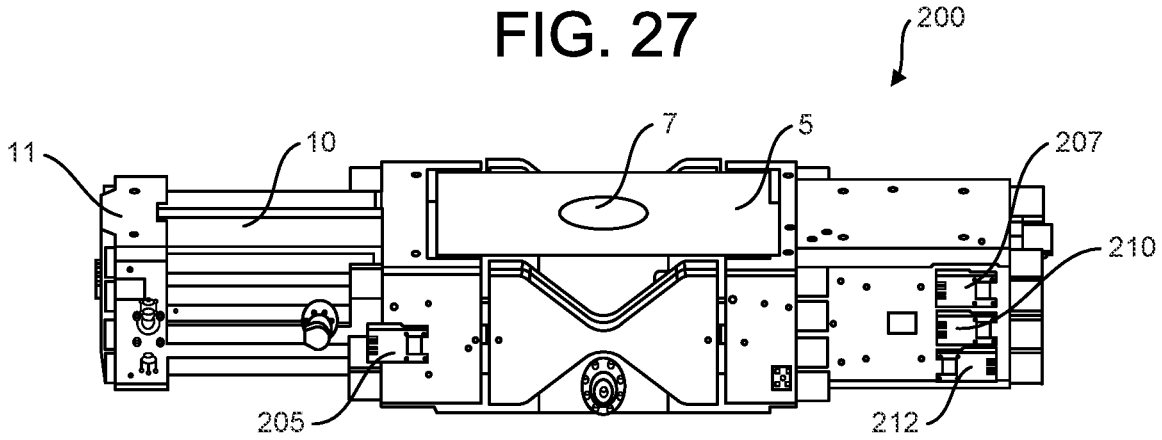
FIG. 28 shows a perspective view of the BOP of FIG. 27.

FIG. 27 shows a plan view of another BOP 200 embodiment of this disclosure. Similar to the BOP 100 described above, this BOP 200 is configured with a main body 5, a through bore 7, a pressure housing 10, and an end cap 11. FIG. 28 shows a perspective view of the BOP 200 of FIG. 27. A first pressure sensor 205 is mounted on the BOP 200 to detect and measure an internal fluid pressure in the transverse passage. A second pressure sensor 207 is mounted on the BOP 200 to detect and measure an internal fluid pressure in a chamber. A third pressure sensor 210 is mounted on the BOP 200 to detect and measure an internal fluid pressure in the transverse passage. And a fourth pressure sensor 212 is mounted on the BOP 200 to detect and measure an internal fluid pressure in a chamber. Conventional pressure sensors may be used with implementations of the BOP 200.

Figure 29:
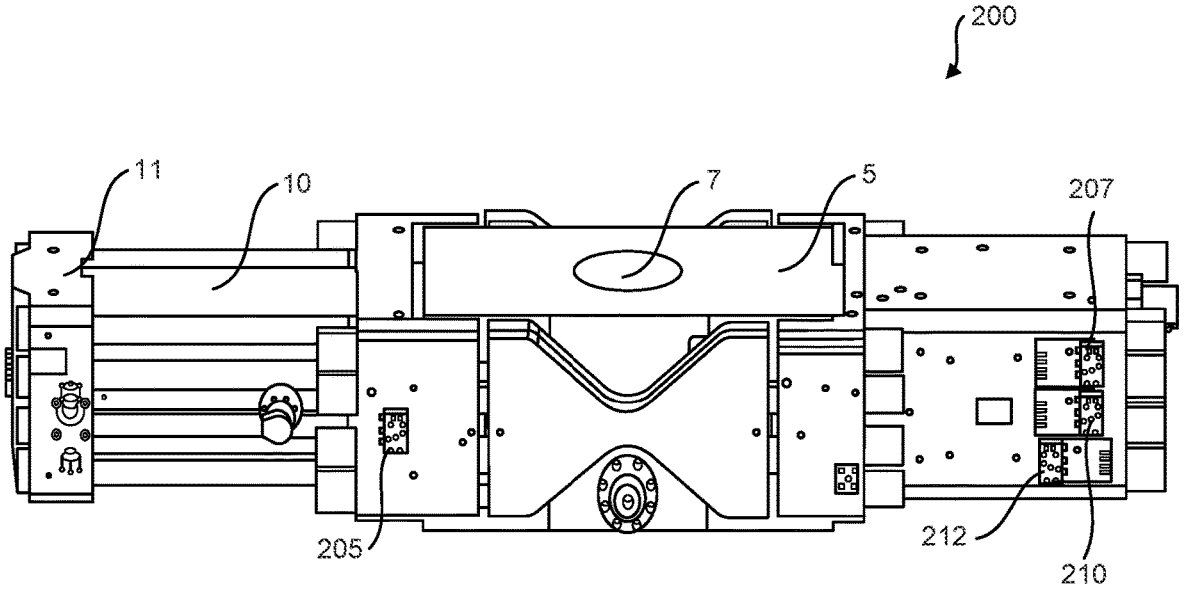
FIG. 29 shows another perspective view of the BOP of FIG. 27.

FIG. 29 shows another perspective view of the BOP 200 of FIG. 28. The sensors 205, 207, 212 are shown without the protective covers (FIG. 28). It will be understood by those skilled in the art that the sensors 205, 207, 212 are mounted with ports formed in the BOP 200 body to permit the respective sensor to detect the internal pressure.

Figure 30:
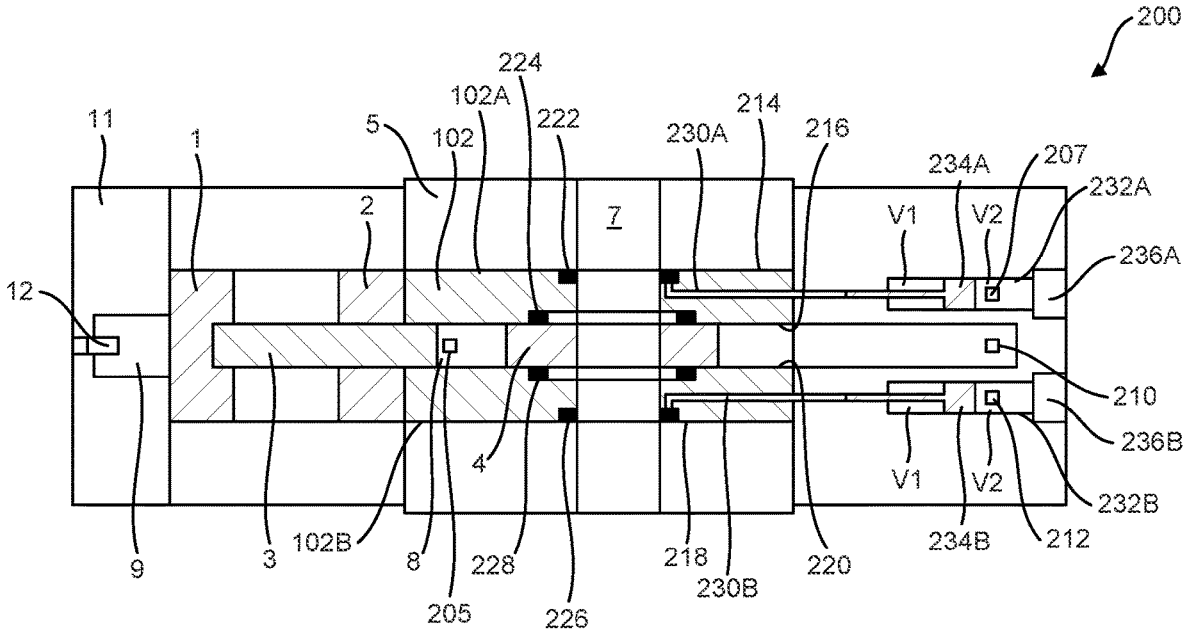
FIG. 30 shows a cross section of the BOP of FIG. 29.

FIG. 30 shows a cross section of the BOP 200 of FIG. 29. This BOP 200 includes a modular insert 102 similar to the BOP 100 described above. The insert 102 is configured with a first insert segment 102A and a second insert segment 102B. The first insert segment 102A has an outer surface 214 and an inner surface 216. The second insert segment 102B also has an outer surface 218 and an inner surface 220. A first annular seal 222 is disposed in a channel formed on the outer surface 214 of the first insert segment 102A, and a second annular seal 224 is disposed in a channel formed on the inner surface 216 of the segment. A third annular seal 226 is disposed in a channel formed on the outer surface 218 of the second insert segment 102B, and a fourth annular seal 228 is disposed in a channel formed on the inner surface 220 of the segment. Seal 222, 224, 226, 228 embodiments for the BOP 200 can be implemented with the seals disclosed in U.S. Pat. No. 12,264,548, incorporated herein by reference in its entirety.

As shown in FIG. 30, the inserts segments 102A, 102B are respectively implemented with porting 230A, 230B that provides a closed fluid channel between the respective bottom of each seal 222, 226 and a pair of pressurized chambers 232A, 232B. Each chamber 232A, 232B includes a piston 234A, 234B configured to slide therein to separate the chamber into two volumes V1, V2. Volume V1 contains a semi-solid compound (e.g., a very high viscosity or thixotropic fluid such as a suitable grease or other semi-solid compound as known in the art). The volume V1 may be pre-loaded with the semi-solid compound during assembly of the structure. Volume V2 contains a suitable gas (e.g. Nitrogen) under pressure. End caps 236A, 236B can be implemented with a fill nozzle to charge the volume V2 with the gas.

With the BOP 200 set for operation, volume V2 in each chamber 232A, 232B is pressurized to push the respective piston 234A, 234B, which in turn pressurizes the semi-solid compound in volume V1, which in turn applies a lifting pressure under the respective seal 22, 226. Thus, these seals 222, 226 are constantly maintained under pressure to provide effective sealing between the respective insert segment 102A, 102B surfaces and the main body 5.

As shown in FIG. 30, the first pressure sensor 205 is mounted on the BOP 200 to detect and measure the internal fluid pressure in the transverse passage 8. Since the BOP s 100, 200 are routinely disposed under water for offshore operations, it is very important to determine if any water has breached the BOP 200 walls to foul the transverse passage 8. Firing of the charge 9 with any water contaminating the pressure housing 10 or transverse passage 8 could be catastrophic. The second pressure sensor 207 is mounted on the BOP 200 to detect and measure the internal volume V2 fluid pressure chamber 232A. The fourth pressure sensor 212 is mounted on the BOP 200 to detect and measure the internal volume V2 fluid pressure chamber 232B. If either of these volume V2 pressures drops below a predetermined pressure, a structural failure mat be present. The third pressure sensor 210 is mounted on the BOP 200 to detect and measure the internal fluid pressure in the transverse passage 8 at the other end of the gate 3. Firing of the charge 9 to propel the gate 3 with any water contaminating the transverse passage 8 could be catastrophic. All of the pressure sensors 205, 207, 210, 212 may be linked to conventional communication means to provide a remote signal (e.g., warning signal if a pressure deviation is detected) as known in the art.

Figure 31:
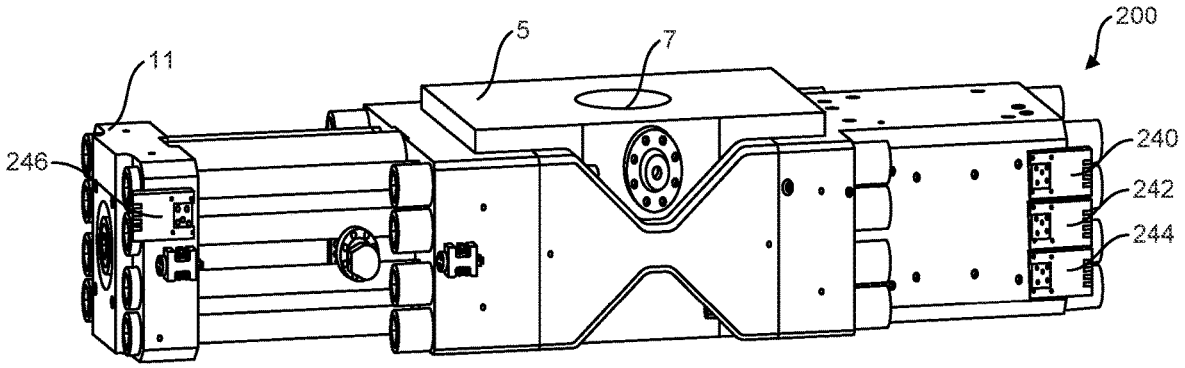
FIG. 31 shows a perspective view of the BOP of FIG. 27.

FIG. 31 shows another perspective view of the BOP 200 from the opposite side shown in FIG. 28. A fifth pressure sensor 240 is mounted on the BOP 200 to. detect and measure an internal fluid pressure in a chamber. A sixth pressure sensor 242 is mounted on the BOP 200 to detect and measure an external ambient pressure. A seventh pressure sensor 244 is mounted on the BOP 200 to detect and measure an internal fluid pressure in a chamber. An eighth pressure sensor 246 is mounted on the BOP 200 to detect and measure an internal fluid pressure in the end cap 11. Conventional pressure sensors may be used with implementations of the BOP 200.

Figure 32:
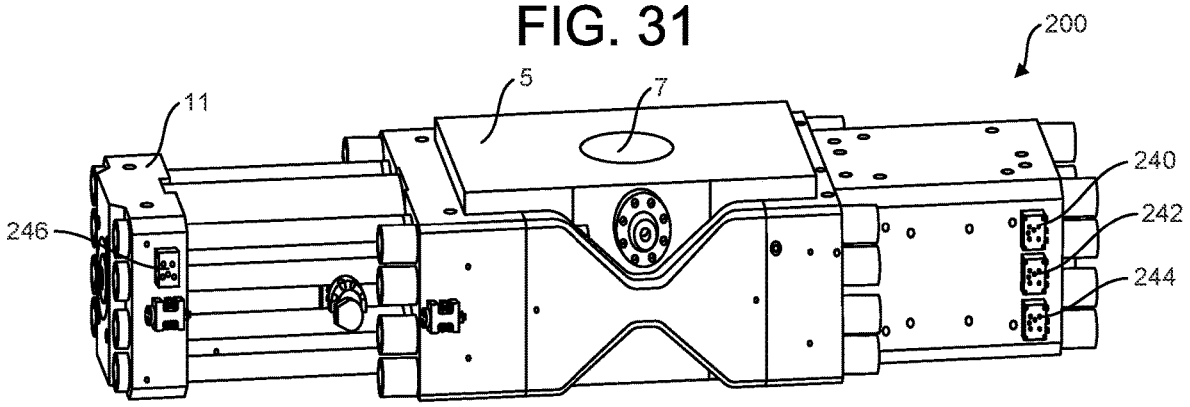
FIG. 32 shows another perspective view of the BOP of FIG. 31.
Figure 33:
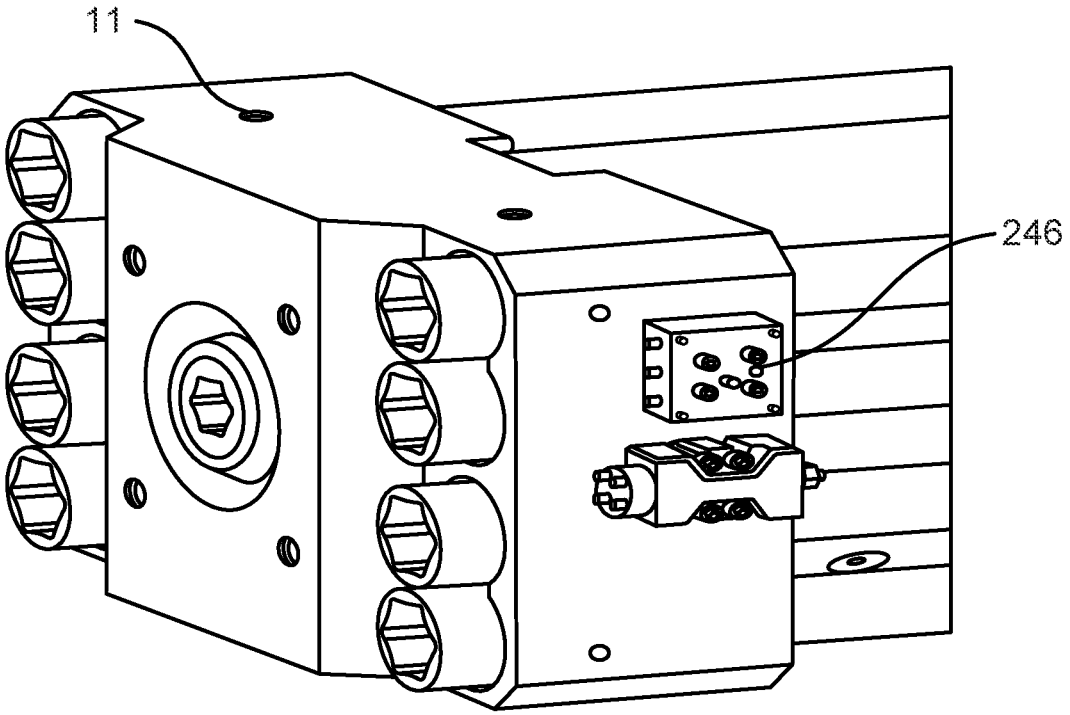
FIG. 33 shows a close-up view of an end cap of the BOP of FIG. 27.
Figure 34:
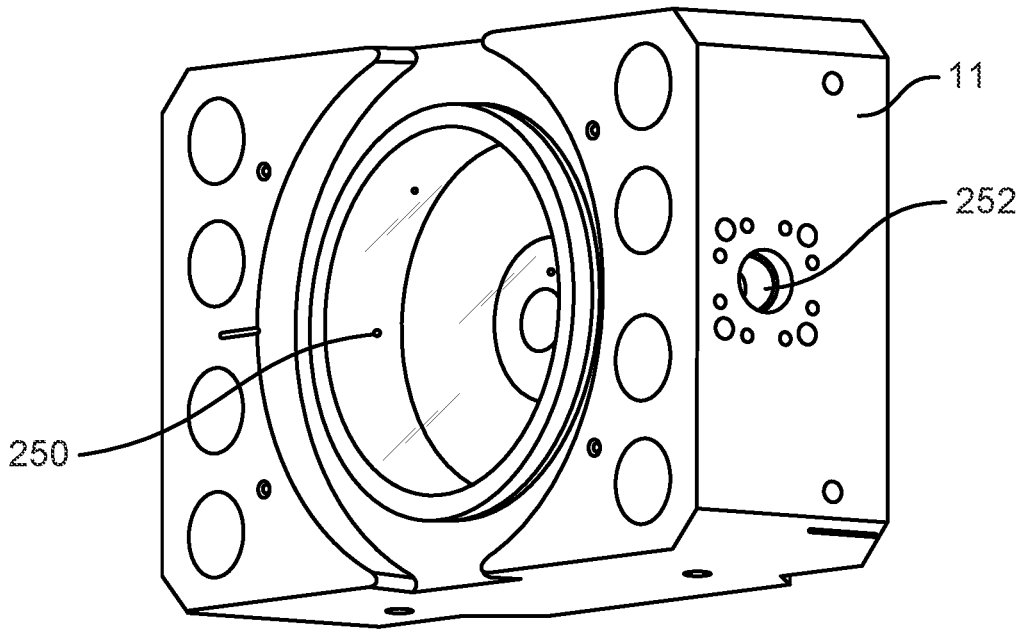
FIG. 34 shows an view of the end cap of FIG. 33.

FIG. 32 shows another perspective view of the BOP 200 of FIG. 31. The sensors 240, 242, 244, 246 are shown without the protective covers (FIG. 31). It will be understood by those skilled in the art that the sensors 240, 244, 246 are mounted with ports formed in the BOP 200 body to permit the respective sensor to detect the internal pressure. FIG. 33 shows a close-up view of the end cap 11 with the pressure sensor 246 mounted on the outer wall. FIG. 34 shows an inside perspective view of the end cap 11. In some embodiments, the cap is configured with one or more internal ports 250 to provide a passage between the internal cap chamber and a pressure sensor mounting port (e.g., 252).

Figure 35:
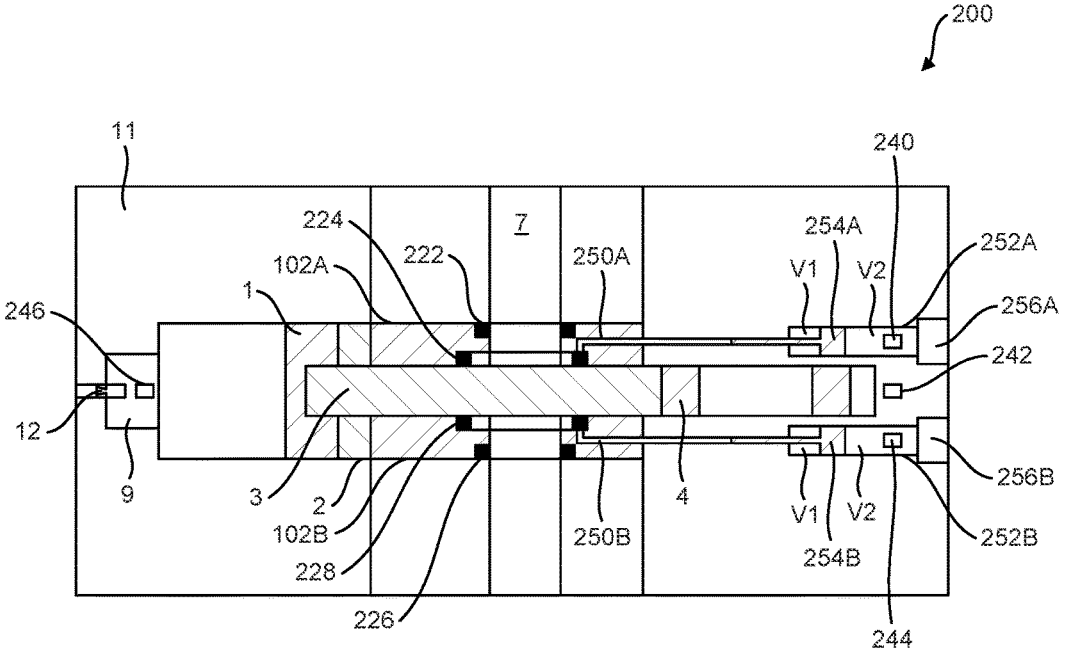
FIG. 35 shows a cross section of the BOP of FIG. 32.

FIG. 35 shows a cross section of the BOP 200 of FIG. 32. As shown in FIG. 35, the inserts segments 102A, 102B are respectively implemented with porting 250A, 250B that provides a closed fluid channel between the respective bottom of each seal 224, 228 and a pair of pressurized chambers 252A, 252B. Each chamber 252A, 252B includes a piston 254A, 254B configured to slide therein to separate the chamber into two volumes V1, V2. Volume V1 contains a semi-solid compound (e.g., a very high viscosity or thixotropic fluid such as a suitable grease or other semi-solid compound as known in the art). The volume V1 may be pre-loaded with the semi-solid compound during assembly of the structure. Volume V2 contains a suitable gas (e.g. Nitrogen) under pressure. End caps 256A, 256B can be implemented with a fill nozzle to charge the volume V2 with the gas.

As shown in FIG. 35, the fifth pressure sensor 240 is mounted on the BOP 200 to detect and measure the internal volume V2 fluid pressure chamber 252A. The sixth pressure sensor 242 is mounted on the BOP 200 to detect and measure the external ambient pressure. For offshore applications, the sixth pressure sensor 242 provides an indication of when the BOP 200 is disposed under water. This provides an added safety feature to prevent undesired activation. The seventh pressure sensor 244 is mounted on the BOP 200 to detect and measure the internal volume V2 fluid pressure chamber 252B. If either of the respective volume V2 pressures drops below a predetermined pressure, a structural failure mat be present. The eighth pressure sensor 246 is mounted on the BOP 200 end cap 11 to detect and measure the internal pressure in the chamber housing the charge 9 (FIGS. 33, 34). Firing of the charge 9 to propel the gate 3 with any water or other contaminant contaminating the charge 9 chamber could be catastrophic. All of the pressure sensors 240, 242, 244, 246 may be linked to conventional communication means to provide a remote signal (e.g., warning signal if a pressure deviation is detected) as known in the art.

It will be appreciated by those skilled in the art that the cutter 4 embodiments of this disclosure are not limited for use in any one particular apparatus such as BOPs. As described, cutter 4 embodiments of this disclosure may be used with any apparatus or housing to sever any object in a bore therein. Although only a few examples have been described in detail above, those skilled in the art will readily appreciate that many modifications are possible in the examples. Accordingly, all such modifications are intended to be included within the scope of this disclosure as defined in the following claims.

What is claimed is:

1. A blowout preventer, comprising:

a main body having a through bore and a passage transverse to the through bore;

a cutter configured for motion to sever objects in the through bore;

a gate configured for motion in the transverse passage; and a charge configured for ignition to produce a gas to propel the gate to move the cutter across the through bore; and at least one sensor to detect an internal pressure associated with a pressure chamber configured to house the gate.

2. The blowout preventer of claim 1, further comprising at least one sensor to detect a fluid pressure associated with at least one seal disposed on a first insert segment in the main body or at least one seal disposed on a second insert segment in the main body.

3. The blowout preventer of claim 1, further comprising at least one seal disposed in the main body to restrict fluid flow between the though bore and the main body.

4. The blowout preventer of claim 1, further comprising at least one sensor to detect an internal pressure associated with a chamber configured to house the charge.

5. The blowout preventer of claim 1, further comprising at least one seal configured for energization.

6. The blowout preventer of claim 5, wherein the at least one seal is configured for continuous energization.

7. The blowout preventer of claim 1, further comprising a plurality of sensors to detect internal pressures.

8. The blowout preventer of claim 1, further comprising at least one sensor to detect an external ambient pressure.

9. The blowout preventer of claim 1, wherein the cutter is configured for positioning with an opening on the cutter coincident with the through bore.

10. A blowout preventer, comprising:

a main body having a through bore and a passage transverse to the through bore;

a cutter configured for motion to sever objects in the through bore; and a gate configured for motion along the passage in response to activation pressurized gas from ignition of a charge, wherein the gate is configured to move along the passage between a position spaced apart from the cutter to a position where the gate contacts the cutter to move the cutter across the through bore; and at least one sensor to detect an internal pressure associated with a pressure chamber configured to house the gate.

11. A method of operating a blowout preventer having a body with a through bore, comprising:

igniting a charge to produce a pressurized gas to propel a gate along a passage in an insert disposed in the body transverse to the through bore;

wherein the gate is propelled from a position spaced apart from a cutter disposed in the passage to a position where the gate contacts the cutter;

allowing the propelled gate to move the cutter across the through bore; and monitoring an internal pressure associated with a pressure chamber configured to house the gate.

12. The method of claim 11, wherein the body comprises at least one sensor to detect a fluid pressure associated with at least one seal disposed on a first insert segment in the body or a second insert segment in the body.

13. The method of claim 11, wherein the body is configured with at least one seal to restrict fluid flow between the though bore and the transverse passage.

14. The method of claim 11, further comprising monitoring an internal pressure associated with a chamber configured to house the charge.

15. The method of claim 11, wherein the body comprises at least one seal configured for energization.

16. The method of claim 15, further comprising monitoring a pressure associated with the at least one seal configured for energization.

17. The method of claim 11, further comprising monitoring internal pressures with a plurality of sensors on the body.

18. The method of claim 11, wherein the cutter is configured for positioning with an opening on the cutter coincident with the through bore.

* * * * *